US006298617B1

(12) United States Patent
de Quesada

(10) Patent No.: US 6,298,617 B1
(45) **Date of Patent: *Oct. 9, 2001**

(54) HIGH RISE BUILDING SYSTEM USING STEEL WALL PANELS

(76) Inventor: Jorge de Quesada, 477 Pacific Ave., San Francisco, CA (US) 94133

( * ) Notice: Subject to any disclaimer, the term of this patent is extended or adjusted under 35 U.S.C. 154(b) by 0 days.

This patent is subject to a terminal disclaimer.

(21) Appl. No.: 09/112,724

(22) Filed: Jul. 9, 1998

Related U.S. Application Data

(63) Continuation-in-part of application No. 08/684,461, filed on Jul. 19, 1996, now Pat. No. 5,782,047.

(30) Foreign Application Priority Data

Jul. 16, 1997 (WO) ..... WO 12409

(51) Int. Cl.[7] ..... E04H 1/00

(52) U.S. Cl. ..... 52/236.3; 52/236.6; 52/481.1; 52/790.1; 52/690; 52/653.2

(58) Field of Search ..... 52/236.3, 236.6, 52/236.8, 79.1, 266, 270, 283, 285.3, 481.1, 483.1, 781.3, 585.1, 790.1, 801.1, 653.2, 693, 690

(56) References Cited

U.S. PATENT DOCUMENTS

| | | | | |
|---|---|---|---|---|
| 4,130,970 | * | 12/1978 | Cable | 52/236.3 |
| 4,514,950 | | 5/1985 | Goodson, Jr. . | |
| 5,218,803 | | 6/1993 | Wright . | |
| 5,706,626 | * | 1/1998 | Mueller | 52/800.12 |
| 5,737,895 | * | 4/1998 | Perrin | 52/236.8 X |
| 5,782,047 | * | 7/1998 | De Quesada | 52/236.6 |
| 5,881,516 | * | 3/1999 | Luedtke | 52/236.3 |

* cited by examiner

*Primary Examiner*—Carl D. Friedman
*Assistant Examiner*—N. Slack
(74) *Attorney, Agent, or Firm*—Coudert Brothers

(57) ABSTRACT

A prefabricated structural system uses wall panels having a combination of cold rolled light gauge sheet metal and hot rolled tubular steel. Panels are stacked one on top of each other to form vertical wall assemblies and may be welded directly with their top and bottom members or include intermediate shear connectors. Shear resistance or resistance to lateral forces is provided by a single continuous metal sheet either flat or corrugated (a deck-type sheet) fastened to the steel studs or alternatively diagonal or V-shaped bracing. Connectors between the wall panels provide a gap for a continuous concrete floor. Vertical wall assemblies can be constructed with individual wall panels either on-site or off-site and then tilted up to form a completed building. The vertical assemblies are then connected together by connector beams or ladder frames. As an alternative to the use of connectors between panels to provide a gap, bracing frames may be provided with diagonal beam bracing and a horizontal cross member where all of the various braced frames are tied together by single continuous left and right vertical tubular members.

8 Claims, 14 Drawing Sheets

HIGH RISE BUILDING SYSTEM USING STEEL WALL PANELS

CROSS REFERENCE TO RELATED APPLICATIONS

This application is a continuation-in-part (CIP) of Ser. No. 08/684,461, filed Jul. 19, 1996 and now U.S. Pat. No. 5,782,047, issued Jul. 21, 1998.

The present invention is directed to a high-rise building system using steel wall panels and, more particularly, a combination of light gauge and heavier gauge hot rolled steel members arranged to resist both vertical and lateral forces.

BACKGROUND OF THE INVENTION

As illustrated in application Ser. No. 684,461, filed Jul. 19, 1996, in the name of the present inventor, for use in a multi-story building, lightweight prefabricated wall panels may be used. The panels include several spaced vertical cold rolled light gauge steel metal studs extending between top and bottom channels in which they are retained. A pair of hot rolled steel members are fixed vertically at the left and right ends of the panel. In addition, to resist shear diagonal bracing plates are specifically shown.

In order to facilitate building with metal beams, Goodson U.S. Pat. No. 4,514,950 discloses a framing technique for steel construction where component parts are pre-assembled and then joined at the job site.

There is still a need to provide for steel designed buildings and construction techniques which are compatible with existing standard design techniques such as supporting dry walls, etc., and which provide for easy fabrication.

OBJECTS AND SUMMARY OF THE INVENTION

It is therefore an object of the invention to provide an improved high-rise building system using steel wall panels.

In accordance with one aspect of the invention, there is provided a lightweight, prefabricated wall panel having left and right ends which is able to resist both vertical and lateral forces for use as a wall in a multi-story building of three or more stories comprising a plurality of spaced vertical cold rolled light gauge sheet metal studs extending between top and bottom steel members to which they are connected. Bracing means are connected to the studs and members for providing resistance to lateral forces, and a pair of hot rolled steel members are affixed vertically to the left and right ends of said panel including the top and bottom steel members and the bracing means. The bracing means include a single continuous metal sheet extending over substantially all of the studs of the wall panel and include means for fastening the metal sheet to the studs and steel members.

From another aspect, there is provided a lightweight, prefabricated wall panel which is both load bearing and shear resistant which may be stacked on top of one another for use as a wall in a multi-story building. Each of the panels have a frame consisting essentially of steel structural members including vertical members and top and bottom steel members which are formed of both cold rolled and hot rolled steel including means for vertically stacking and interlocking the panels. The cold rolled steel provides lightweight and the hot rolled steel provides for enhanced resistance to vertical forces. Means for stacking and interlocking include a plurality of discrete steel connectors with the top being welded to one of the top or bottom steel members and with the bottom being welded to the adjacent vertically stacked panel whereby enhanced resistance to shear is provided.

From another aspect, there is provided a prefabricated vertical frame assembly, which may be used as a portion of a wall in a multi-story building comprising a plurality of vertically stacked wall panels consisting essentially of tubular hot rolled steel structural members having a top and a bottom steel members, vertical side members and bracing means to resist lateral forces, the wall panels forming a unitary vertical assembly by the respective top and bottom steel members being fastened together.

As a modification of the foregoing, there is provided a prefabricated vertical frame assembly which may be used as a portion of a wall in a multi-story building comprising a plurality of vertically stacked wall panels consisting essentially of tubular hot rolled steel structural members including a horizontal steel member and at least one diagonal bracing member for resisting vertical and lateral forces. The wall panels form a unitary vertical frame by the horizontal steel members and bracing members being fastened to a pair of vertical left and right hot rolled steel side members, such side members having a continuous uninterrupted length equal to the plurality of stacked panels.

DETAILED DESCRIPTION OF PREFERRED EMBODIMENTS

Figure 1:
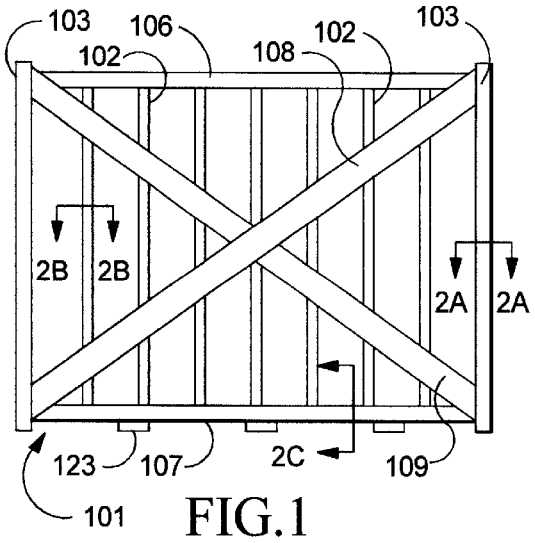
FIG. 1 is an elevation view of one embodiment of a wall panel of the present invention.
Figure 4:
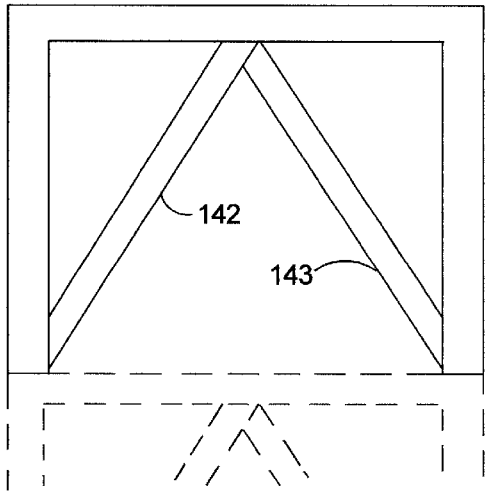
FIG. 4 is an elevation view of another embodiment of a wall panel of the present invention.
Figure 3:
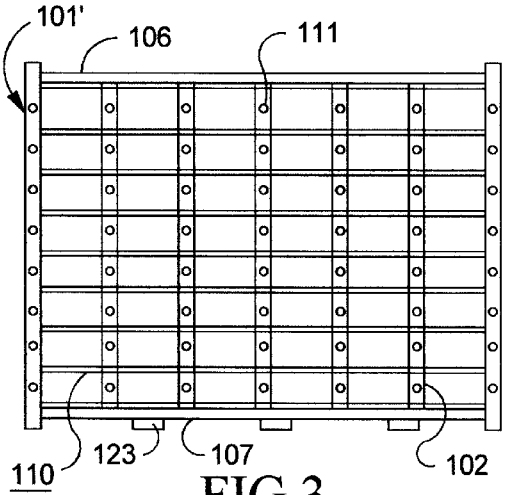
FIG. 3 is an elevation view of another embodiment of a wall panel of the present invention.

FIGS. 1, 3 and 4 illustrate different wall panels having both hot and/or cold rolled components which are suitable as wall panels for buildings of various heights. Very briefly, each panel is resistant to both vertical (bearing) and lateral force (shear) components. That is, they first serve as bearing wall systems and then they also resist lateral force by the use of either diagonal bracing or a continuous metal sheet.

Figure 2A:
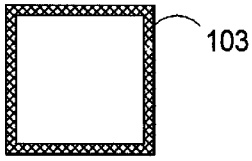
FIG. 2A is a cross-sectional view taken along line 2A—2A of FIG. 1.
Figure 2B:
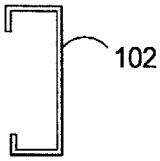
FIG. 2B is a cross-sectional view taken along line 2B—2B of FIG. 1.
Figure 2C:
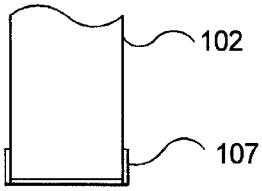
FIG. 2C is a cross-sectional view taken along line 2C—2C of FIG. 1.

FIG. 1 illustrates a wall panel 101 similar to that shown in the above copending parent application in that it includes a plurality of spaced vertical cold rolled light gauge steel studs 102 which have a C-type cross-section as shown in FIG. 2B. These studs are preferably made of cold rolled steel having a thickness from 18 through 12 gauge. To provide for greater vertical and lateral force resistance, a pair of hot rolled steel tubular members 103 (see the cross-section of FIG. 2A) are provided on the left and right ends of the panel 101. Both these studs 102 and tubular members 103 are retained by top and bottom steel horizontal members 106 and 107. These top and bottom members may either be U-shaped channels made of lightweight steel as illustrated in FIG. 2C or hot rolled tube type members. Whether to use the C-type light gauge sheet metal section or the hot rolled tube type, depends on load resistance requirements.

Still referring to FIG. 1 and its relationship to the parent application, in that application in order to provide resistance to lateral forces or shear, diagonal bracing plates 108, 109 are connected to all of the other components.

However, as illustrated by the partial horizontal lines 110 on a wall panel 101' in FIG. 3 bracing may alternatively be provided a single continuous metal sheet, the sheet being fastened to the studs 102, the tubular vertical members 103 and the top and bottom steel members 106, 107 (either C-channel or hot rolled steel tubes). The single continuous metal sheet extends substantially over all of the studs of the wall panel. This is believed to provide greater shear resistance or resistance to lateral forces than diagonal bracing.

Thus, the panels of FIG. 1 might be used for a three or four story building and the greater shear resistant panels of FIG. 3 would be suitable for a four to five story buildings. And then, if the sheet metal studs 102 are replaced with tubular hot rolled steel, more than six stories can be constructed.

FIG. 4 illustrates a tubular steel (TS) (hot-rolled) diagonally V-braced (142–143) frame (BF) which may be used for multi-story buildings; e.g., eight to ten stories of 80 to 100 feet. Details of the use of this bearing frame will be discussed with FIGS. 24–31. Alternatively, the lower stories of a building may have the wall panels of FIG. 4 with the upper stories having the wall panels of FIGS. 1 or 3.

Figure 5:
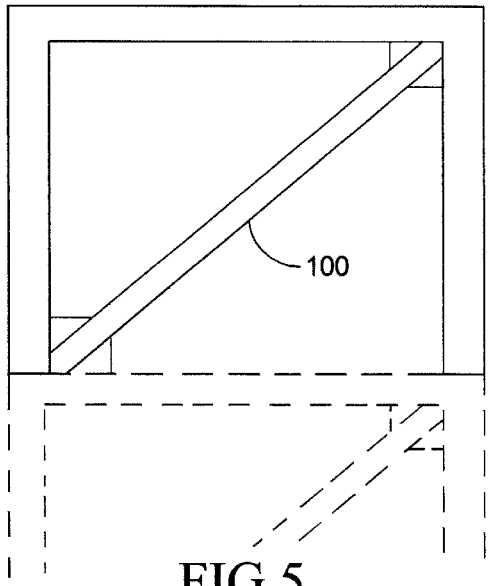
FIG. 5 is an alternate embodiment of FIG. 4.

FIG. 5 is an alternative to FIG. 4 having only a single diagonal bracing member 100.

The single continuous metal sheet 110 may be, as illustrated in FIG. 3, a substantially planar sheet of light gauge sheet metal or corrugated steel sheets which are normally used in the construction process for the decking or floors of multi-story buildings. Both the planar steel sheets or the corrugated type may be fastened to the various studs 102 (as well as members 103, 106 and 107) by screw-type fasteners 111 or welding.

The use of a single continuous metal sheet for resisting lateral loads either of the planar or corrugated decking type has several advantages:

1. There is greater resistance to seismic forces under the Uniform Building Code in comparison to diagonal or sheet metal bracing systems.
2. Dry walls are easily supported.
3. Sound proofing may be easily added by a simple screw-on technique.
4. The continuous metal sheets provide continuous lateral bracing for sheet metal cold rolled studs 102 and eliminate the need to provide interim or third point intermediate struts between studs 102 (for example, as shown in FIG. 1 midway between the top and bottom steel members 106 and 107).
5. Fabrication and installation of the single continuous sheet metal sheet is much easier than other bracing techniques.
6. The shear values of steel-type decking (corrugated sheets) are well known, tabulated, and accepted by building code officials.
7. Th ere is width compatibility with bearing only walls. Both steel decking and metal studs are in the same type of inch increments.

Figure 6:
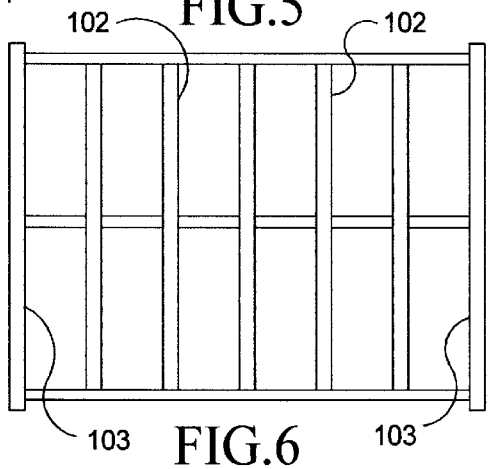
FIG. 6 is a simplified elevational view of an alternative wall panel.

Either light gauge C-section steel or tubular steel as shown in FIGS. 2B and 2A, respectively, may be used for a load bearing only or vertical load components. FIG. 6 illustrates a load bearing only wall because there are no shear resistant components. Thus, the wall of FIG. 6 could either be the wall of FIG. 1 with the diagonal bracing 108 and 109 removed or FIG. 3 with the continuous shear wall 110 not present. Thus, it is indicated as typically having a number of interior light gauge cold rolled section steel studs 102, intermediate bracing 99, and then the end studs of hot rolled tubular steel 103. But it could be many combinations.

Figure 7:
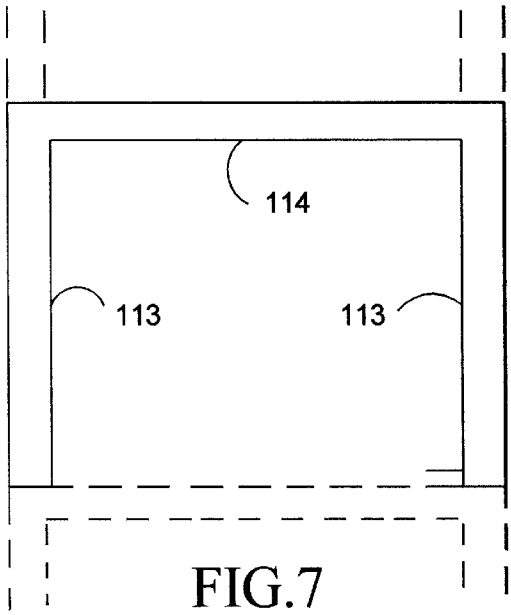
FIG. 7 is a simplified elevational view of another wall panel.

FIG. 7 illustrates a tubular steel ladder or portal frame having vertical tubular steel members 113 and a similar horizontal member 114. Finally, any of the panels of FIGS. 1 through 7 may form a rigid vertical frame to be assembled into a building and use common sub-assemblies as, for example, the floor panel (FP) of FIG. 8 having interior cold rolled joists 126 retained by light gauge track channels members 105.

Figure 10:
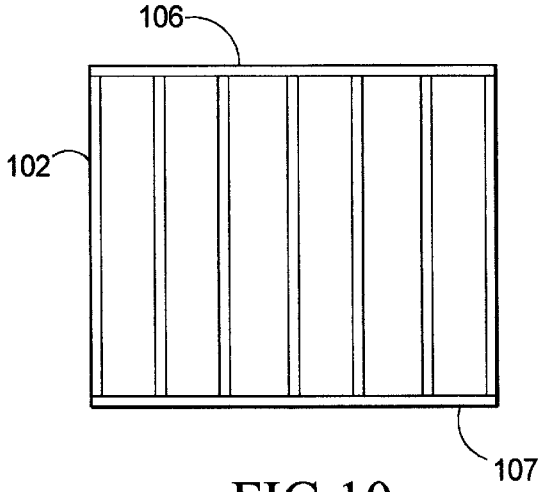
FIG. 10 is a simplified elevational view of an interior partition.
Figure 11:
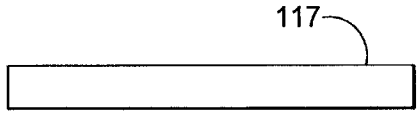
FIG. 11 is a side elevational view of a short beam used in the present invention.
Figure 9:
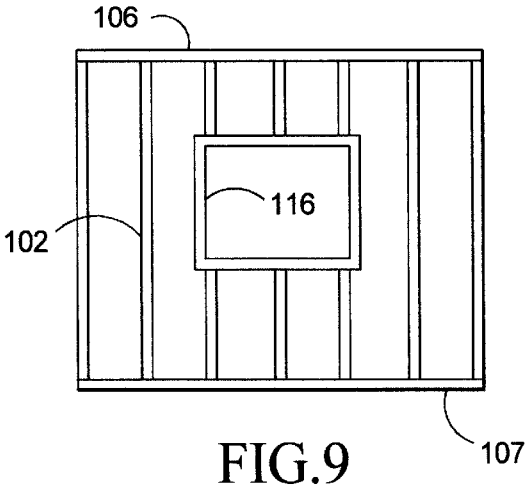
FIG. 9 is a simplified elevational view of a wall panel.
Figure 12:
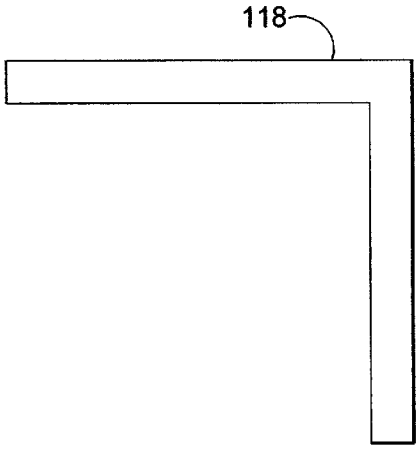
FIG. 12 is a side elevational view of an outrigger or "L" shaped assembly comprising a beam and a column used in the present invention.

FIG. 9 illustrates a typical exterior wall panel composed of light gauge members 102, 106, 107 with a window aperture 116 inserted. This is, of course, for a non-bearing wall. FIG. 10 illustrates a non-load bearing interior partition exclusively of cold-rolled studs 102 with top and bottom retaining channels of cold-rolled steel members 106 and 107. Finally, to connect these various walls as will be illustrated below there are short beams 117 and L-shaped outrigger construction beams 118 as illustrated in FIGS. 11 and 12, respectively.

Figure 13:
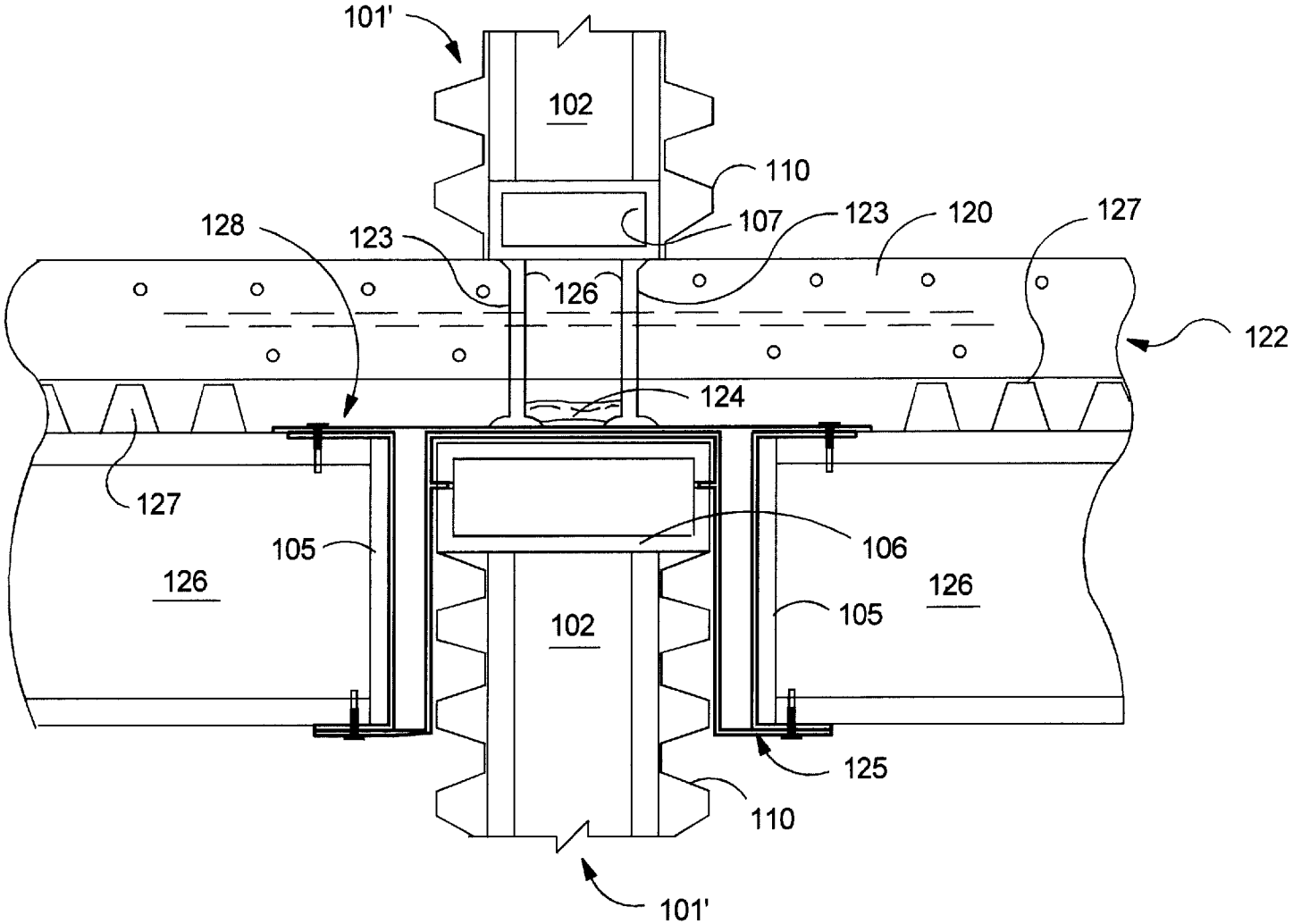
FIG. 13 is a detailed cross-sectional view of a floor joint in combination with a bearing wall.

FIG. 13 is a wall/floor joint detail illustrating the typical use of the wall 101' of FIG. 3 which has the corrugated shear panel 110. The vertically stacked walls 101' are separated by a concrete floor 120 and a steel deck 127. For the upper wall panel 101', the bottom or horizontal member 107 is tubular steel. With respect to the lower stacked wall panel 101', its top or horizontal steel member 106 is again tubular steel but of a greater width. This aids in covering the corrugations 110 of shear panel and isolating it from the concrete floor 120 and from the above floor.

In order to form a multi-story building, of course, the wall panels 101 or 101' or their variations must be vertically stacked and interlocked. One technique as illustrated in the above parent application is the use of fasteners or to weld together the top and bottom channels 106 and 107. Another technique illustrated in the above parent application is a spacing bolt to provide room for the concrete floor or decking.

Figure 14C:
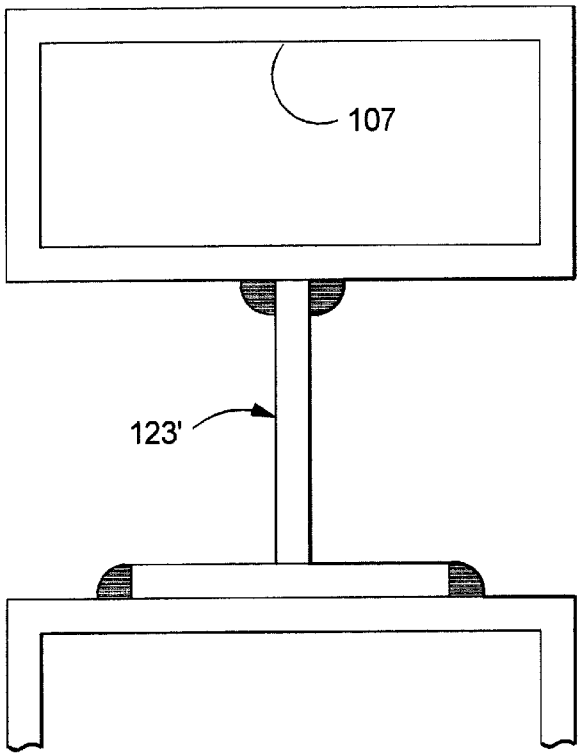
FIG. 14C is a cross sectional view of an alternative embodiment of FIG. 14B.
Figure 14B:
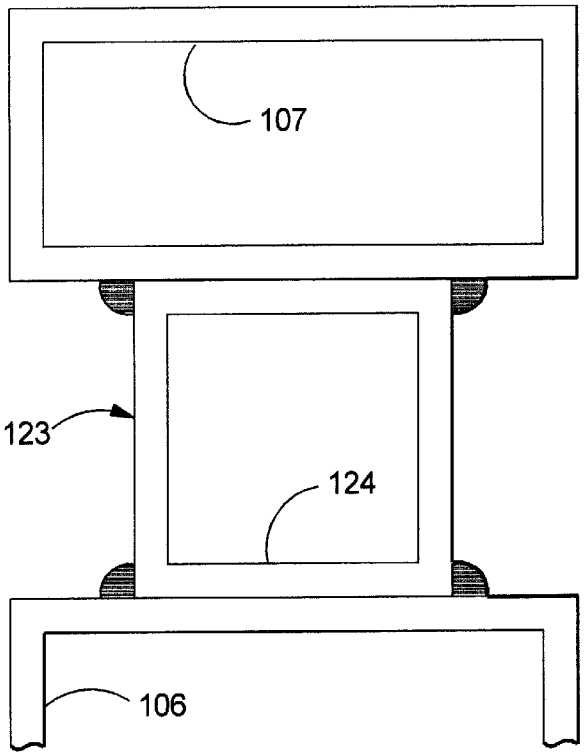
FIG. 14B is a simplified cross-sectional view of a portion of FIG. 13.

FIG. 13 illustrates yet another spacing technique which besides providing a gap 122 between the wall panels of adjacent floors to allow room for a concrete floor 120 provides discrete connectors 123 of steel which are welded to top and bottom members 106 and 107 to thus resist shear. These connectors 123 are also illustrated in FIGS. 1 and 3. Both figures show several discrete connectors 123 spaced along the bottom steel member 107 of the wall panels. As illustrated in FIG. 13 and in detail in FIG. 14B, the steel connector is generally U-shaped with the bottom 124 of the U being welded to an upper steel chord member 106 and the two legs being welded to the bottom chord member 107 of the upper wall panel 101'. Alternatively, as shown in FIG. 14C such discrete connector 123' may be T-shaped. The discrete connector members 123 or 123' may be welded off the site at a fabrication shop onto one of the wall panels and then the job finished in the field. Connectors 123 besides providing shear resistance allows the concrete floor 120 to be continuously poured through the gap 122 provided by the shear connectors. Such floor when reinforced with steel rods and meshing with a corrugated steel deck works as a diaphragm to structurally tie together the vertical load bearing wall assemblies to hold the resultant building together.

Figure 8:
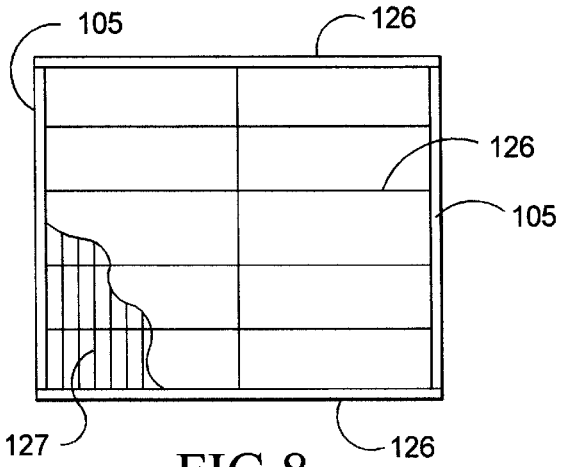
FIG. 8 is a simplified top view of a floor panel.
Figure 14A:
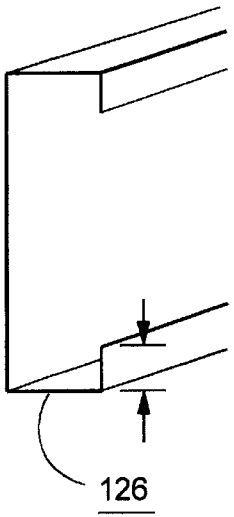
FIG. 14A is a perspective view of a joist of FIG. 13.

Floor panel assemblies (FP) such as illustrated in FIG. 8 are supported by the use of a U-shaped saddle track or hanger 125 hung over the top chord member 106. Such floor panels (see FIG. 8) are composed of light gauge C joists 126 (see FIG. 14A) retained by light gauge track channels 105 at each support end. These floor panel assemblies have a corrugated metal deck 127 (see FIG. 8) attached to their top surfaces, ready to receive a concrete floor 120 and a bottom surface ready to receive a finish ceiling.

Figure 15:
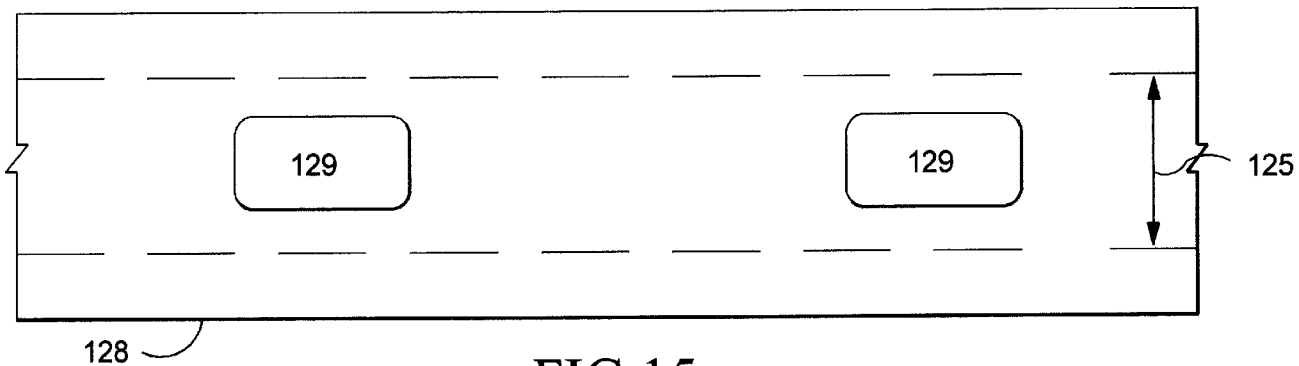
FIG. 15 is a plan view of a portion of the present invention.
Figure 16:
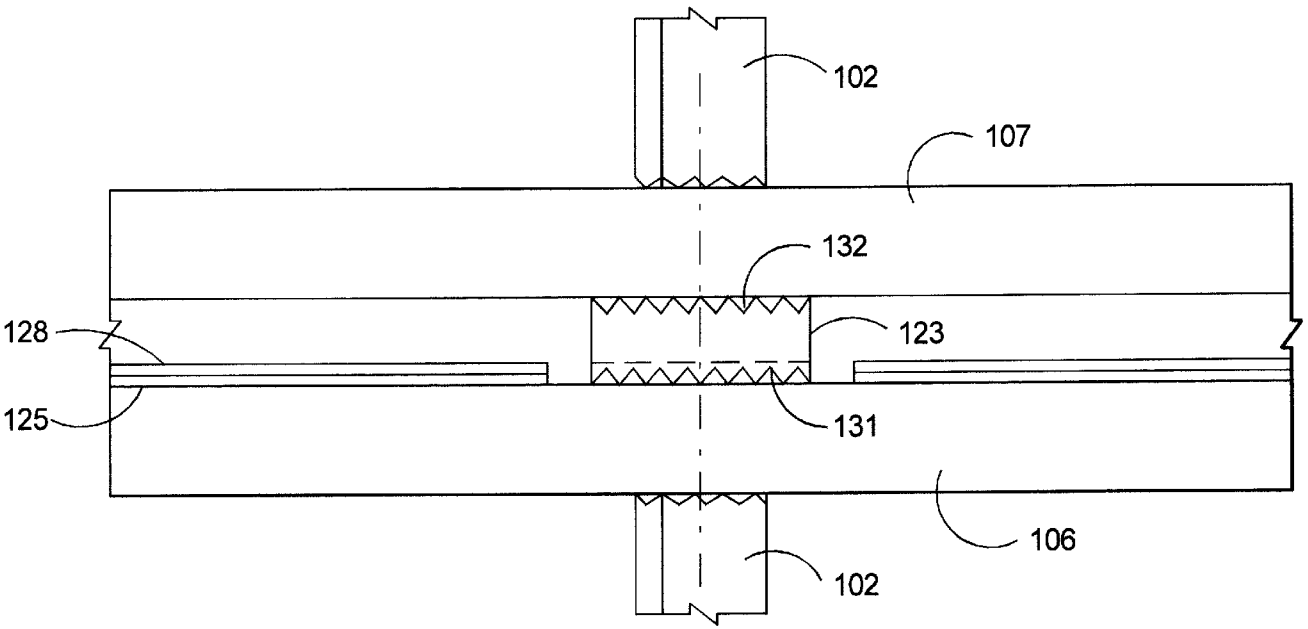
FIG. 16 is a side elevational view showing a simplified portion of FIG. 13.
Figure 17:
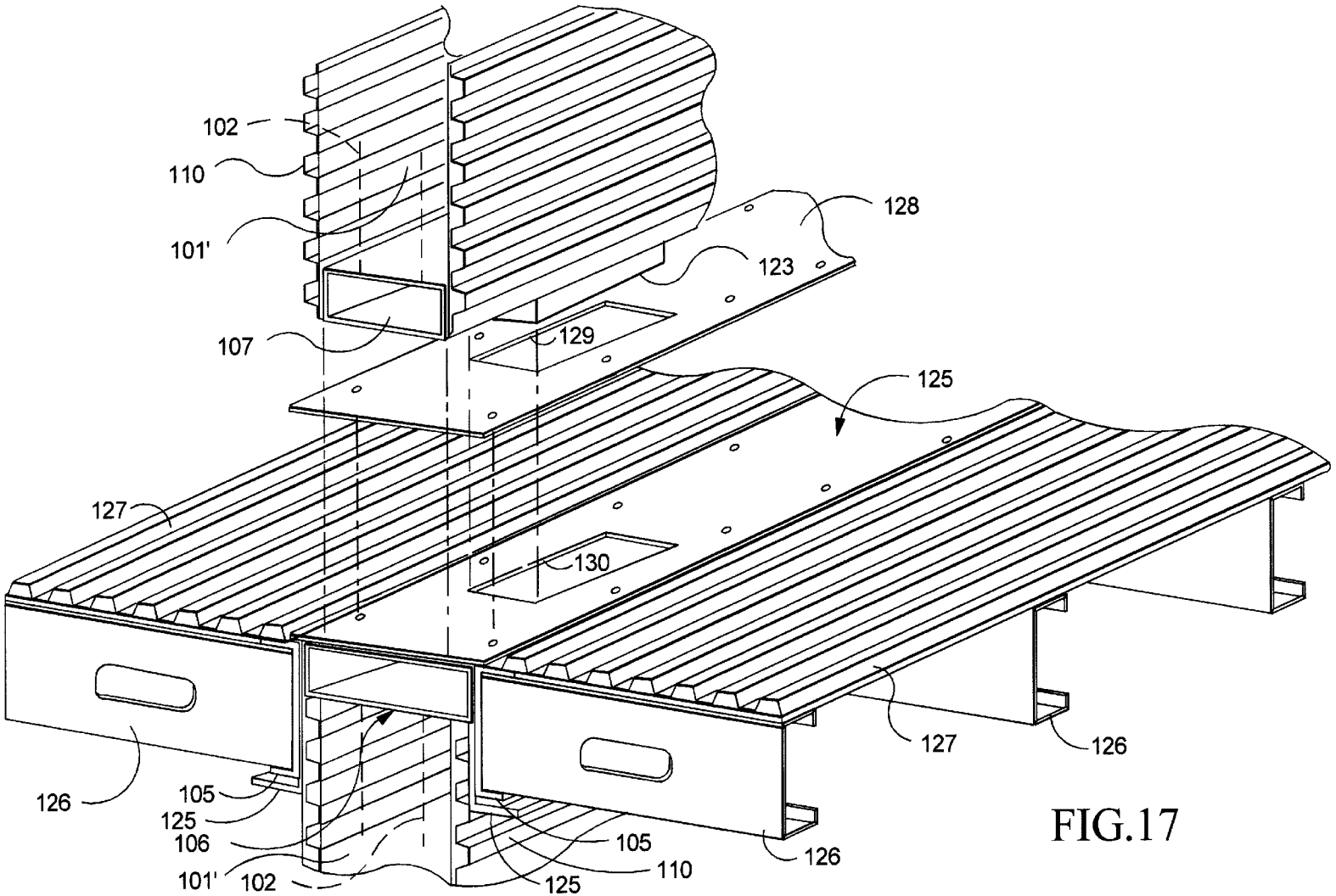
FIG. 17 is an exploded view of FIGS. 13 and 16 showing a floor point

To provide further isolation between floors is steel closure plate 128 in strip form placed on top of the upper chord 106. This is better illustrated in FIGS. 15 and 16. Here, as illustrated in FIG. 15, plate 128 has pre-punched openings 129 through which the shear connectors 123 may extend. The top and bottom steel members or chords 106 and 107 are illustrated in FIG. 16 and the exploded view of FIG. 17 where they terminate cold rolled studs 102 and where the shear connector 123 is illustrated. Moreover, the two welds are illustrated, one a field weld at 131 and the other a shop weld at 132 for the top of the connector. Then, there is the saddle track 125 which also has apertures 130 along with the cover plate. Cover plate 128 also serves the purpose of covering the wall ends and the corrugated decking to provide isolation when the concrete floor is poured. These wall ends would include gypsum wall board and the corrugated shear panels. In FIG. 16, the shear panels have been eliminated for the sake of simplicity.

Figure 19:
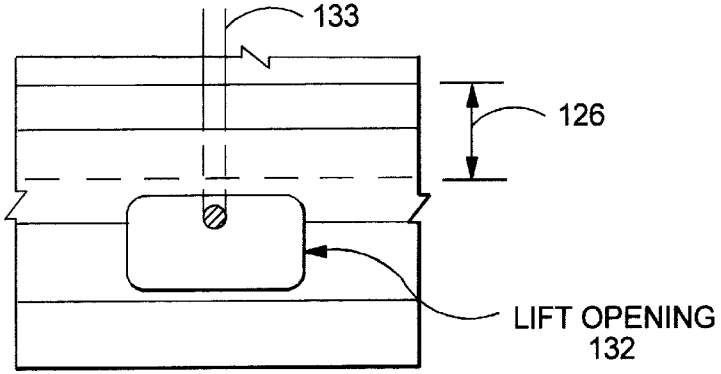
FIG. 19 s a side elevation view taken along the line 19—19 of FIG. 18.
Figure 20:
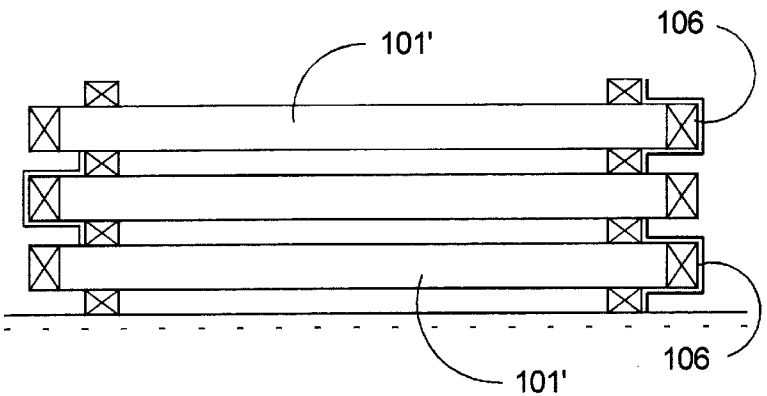
FIG. 20 is a side elevational view showing the stacking of various wall panels.
Figure 18:
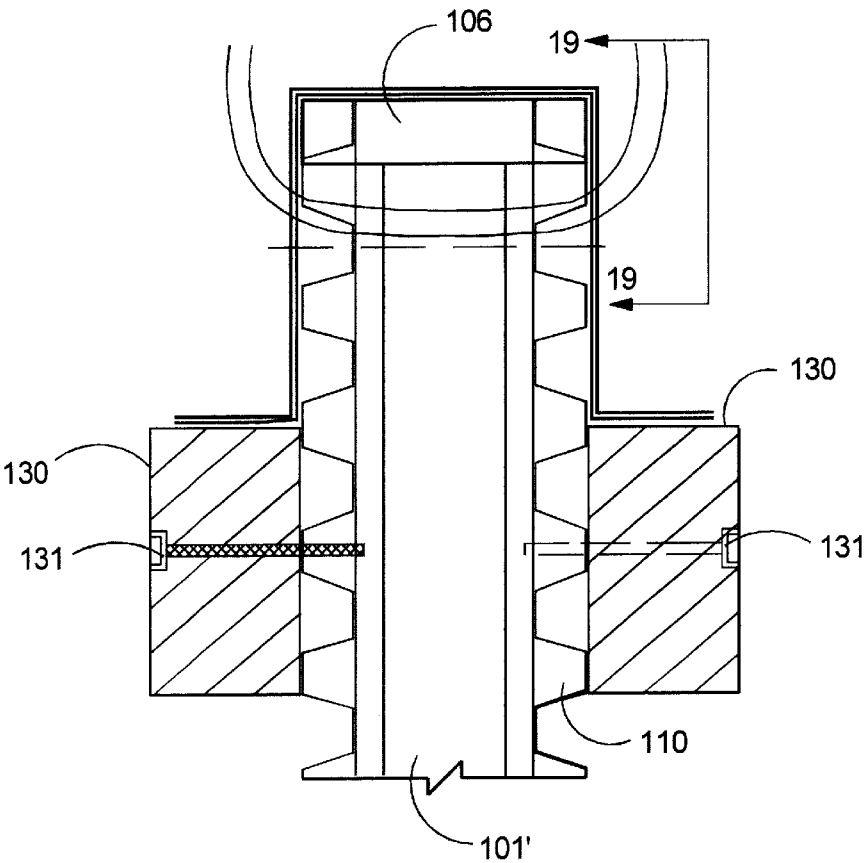
FIG. 18 is a cross-sectional view of a wall assembly to illustrate stacking and lifting.

FIGS. 18, 19 and 20 illustrate how the wall panels especially those of FIGS. 1 and 3, that is 101 and 101', may be stacked and lifted conveniently. FIG. 19 illustrates a wall panel 101' with corrugated decking 110 having attached thereto temporary stacking blocks of 130 which are of wood and temporarily screwed to the panel by fasteners 131. There, for example, may be eight blocks to a panel; four on each side. To facilitate lifting, especially as shown in FIG. 19, a lift opening 132 illustrated in both FIGS. 18 and 19 accommodates the rope cable or hook 133 which is inserted through the opening to provide a lifting action. The lift opening is preferably placed adjacent a hot rolled steel tubular chord or member such as 106. In other words, this is an upper or top steel member to complete the wall panel 101'. FIG. 20 shows the top chords 106 and the bottom chords 107 which are alternated over three stacked panels.

Figure 21:
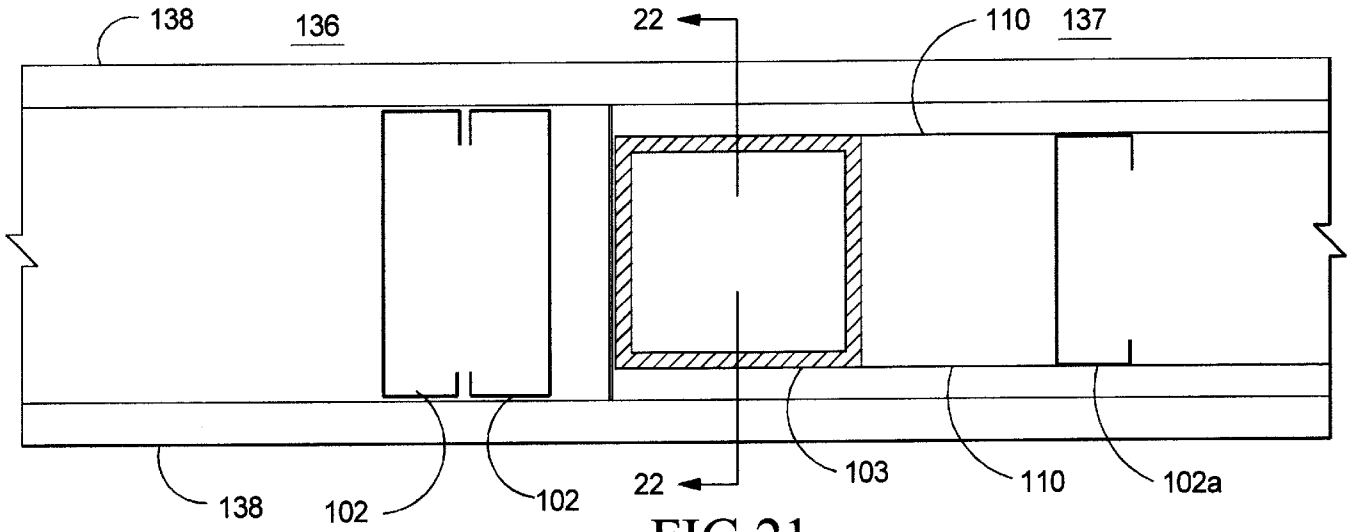
FIG. 21 is a cross-sectional view showing an embodiment of a wall assembly.
Figure 22:
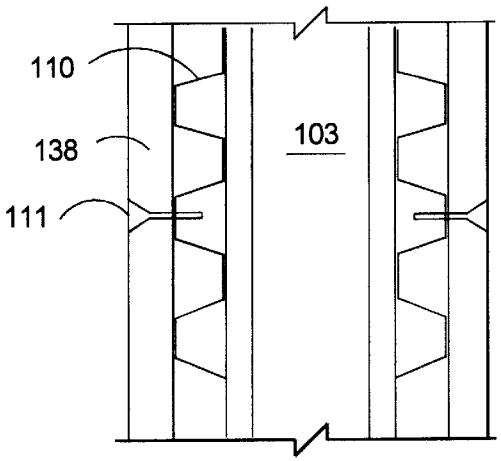
FIG. 22 is a cross-sectional view taken along the line 22—22 of FIG. 21.

For the installation of dry wall (sheet rock), surface compatibility is desired between bearing only and shear/bearing wall assemblies; for example, as in FIGS. 1 and 2 which are both shear/bearing wall systems because of the diagonal or shear panels and the load bearing only wall of FIG. 6 which may consist of only light gauge steel studs 102. Referring to FIG. 21, on the left is a bearing only wall section 136 and on the right a shear/bearing wall assembly 137. Section 136 has back-to-back C-shaped studs 102 and then placed on that is a dry wall 138. The C-shaped studs 102 may typically have a standard dimension of six or eight inches and the dry wall about ⅝ inch. Then, for the shear/bearing wall section 137 there is an end steel member 103 (see FIGS. 1 and 2A) having a typical four to six inch dimension where corrugated steel decking 110 having a typical dimension of one inch may be placed on it to provide a, for example, six inch thickness upon which the dry wall 138 may be extended. Sheet metal stud 102*a* represents an infill stud. Thus, a single planar surface match or compatibility is formed between the cold rolled studs 102 and the hot rolled steel tubing 103. The cross-section of FIG. 22 illustrates the steel tubing 103 upon which the corrugated panels 110 is placed. Then, the gypsum wall board 138 is applied directly to the corrugated steel panels 110. Thus, in summary C-shaped studs 102 having typical six or eight inch width dimensions may be matched with bearing shear walls where an added thickness of corrugated steel decking 110 of one inch is necessary for lateral resistance.

Figures 23, 23A:
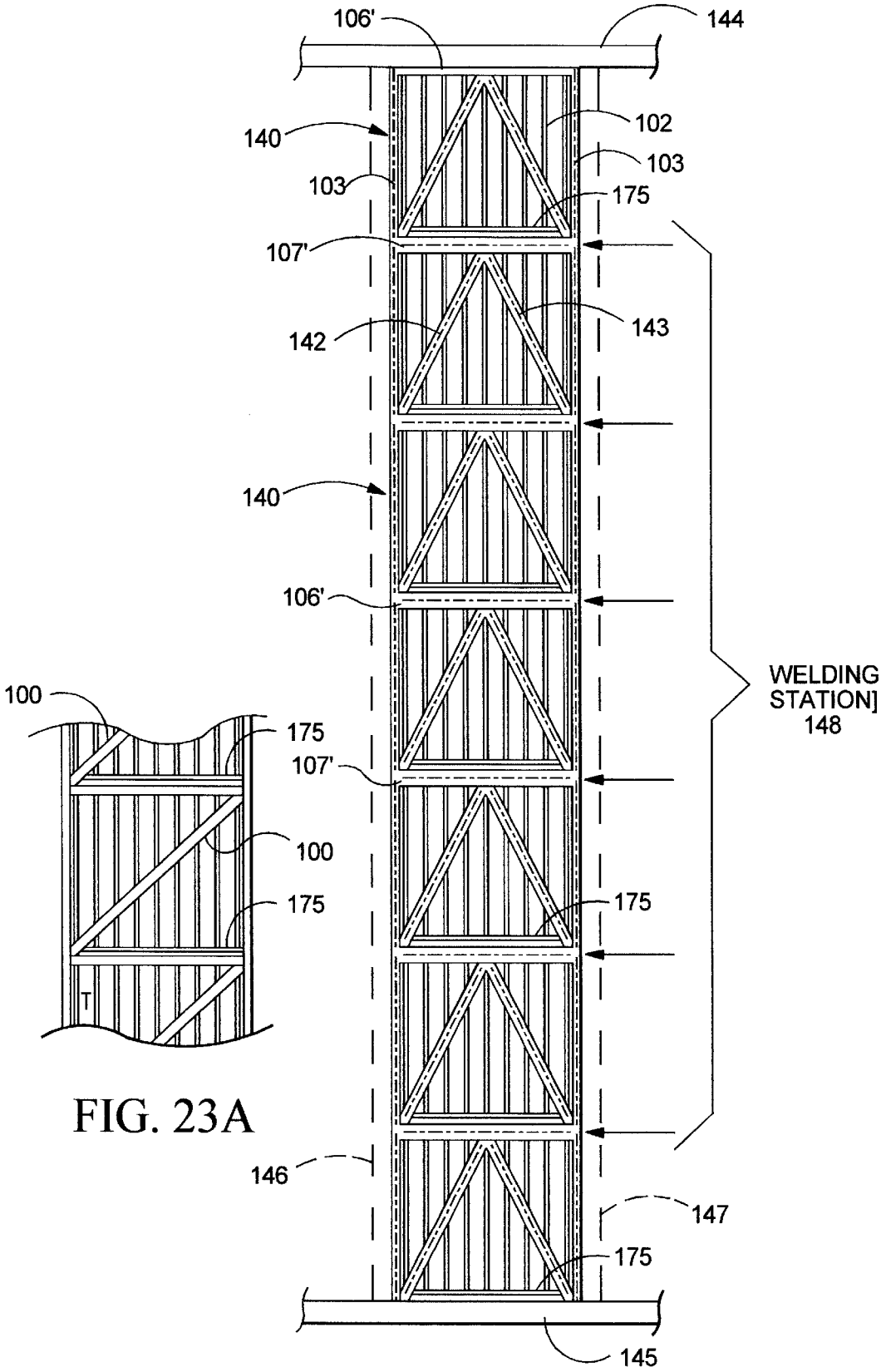
FIG. 23 is a top view showing a method by which a vertical frame assembly embodying the present invention is constructed.
FIG. 23A is an alternative embodiment of FIG. 23.

FIG. 23 illustrates a vertical frame assembly made of tubular hot rolled steel which is fabricated as a unitary assembly either on-site or off-site. In the form shown in FIG. 23, it includes for each panel section 140 the light gauge studs 102, hot rolled steel end beams 103 on the left and right ends and top and a bottom steel members 106' and 107' which are formed from hot rolled steel tubing. This provides a vertical load and shear resistant vertical frame assembly in a multi-story building. The infill studs 102 retained at their bottoms by cold rolled steel members 175 provide a suitable backing for dry wall. To provide for some shear resistance, of course, a single continuous sheet metal shear panel could be used such as 110 or 110'. But in the embodiment shown in FIG. 23, there is V-shaped hot-rolled steel bracing with the legs 142 and 143. This provides the highest level of shear resistance and is ideal for earthquake prone areas. The alternative of FIG. 23A illustrates panel/sections with a single diagonal brace 100 (see FIG. 5). A unitary one-piece vertical frame assembly is made by laying the individual panels 140 horizontally on the ground between the end guides 144 and 145 and the side guides indicated by dashed lines 146 and 147. Then the various welding stations 148 as indicated by the arrows are provided at the contact points of the top and bottom steel members of each wall panel and they are welded together (alternatively, other types of screw connectors 123 or bolt fasteners may be used). The entire unit is tilted up to form a portion of a wall of a building. If constructed off-site, it should be compatible with allowable road transit restrictions.

Figure 24:
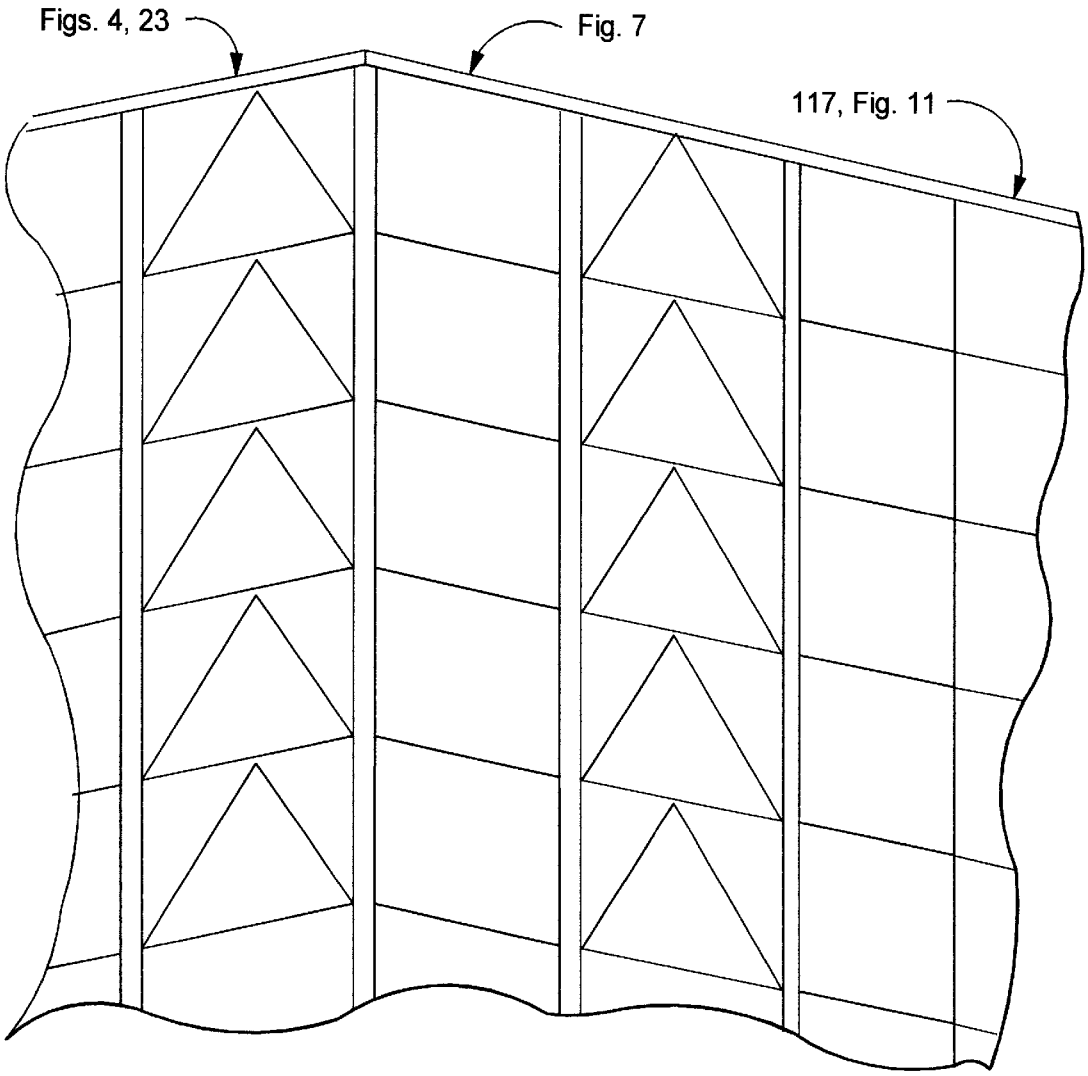
FIG. 24 is a simplified perspective view of a partial space frame in a tall building using vertical frame assemblies.

FIG. 24 illustrates vertical frame assemblies formed by the wall panels such as the one shown in FIGS. 4 and 23. They may be interlocked by connector beams 117 (FIG. 11) or the ladder frame of FIG. 7. FIG. 25 is a top cross-sectional view of a typical construction.

Figure 26:
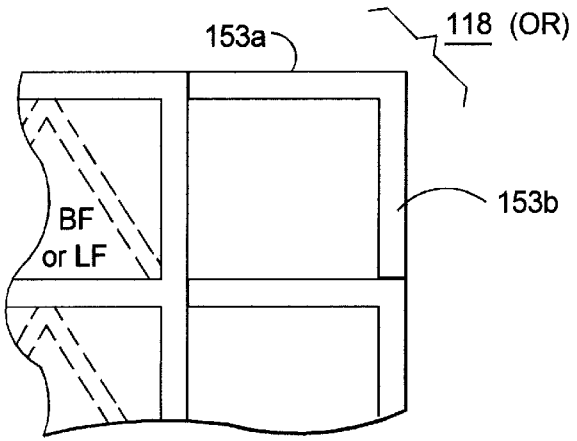
FIG. 26 is a vertical detailed plan view of a portion of FIG. 25.

FIG. 25 shows the wall plan of a building constructed in accordance with the present invention which is a combination of vertical frame assemblies formed of braced frames (BF), see FIGS. 4 and 5 ladder frames (LF), see FIG. 7 and ordinary beams designated 117 (see FIG. 11) and floor panels (FP) illustrated in FIG. 8. In addition, illustrated in the detailed view of FIG. 26 is an alternative outrigger (OR) construction, which is a side view of FIG. 25, showing L-shaped beam (153*a*)/column (153*b*) combination as in FIG. 12 (118).

Figure 25A:
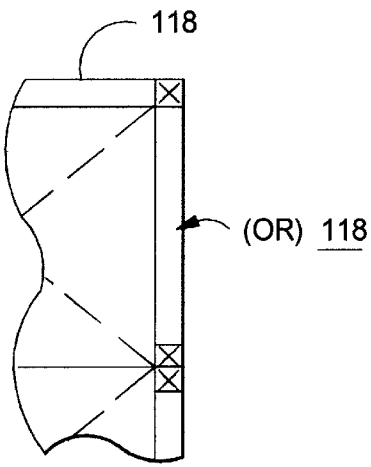
FIG. 25A is an alternate embodiment of a portion along line 25A—25A of FIG. 25.
Figure 25:
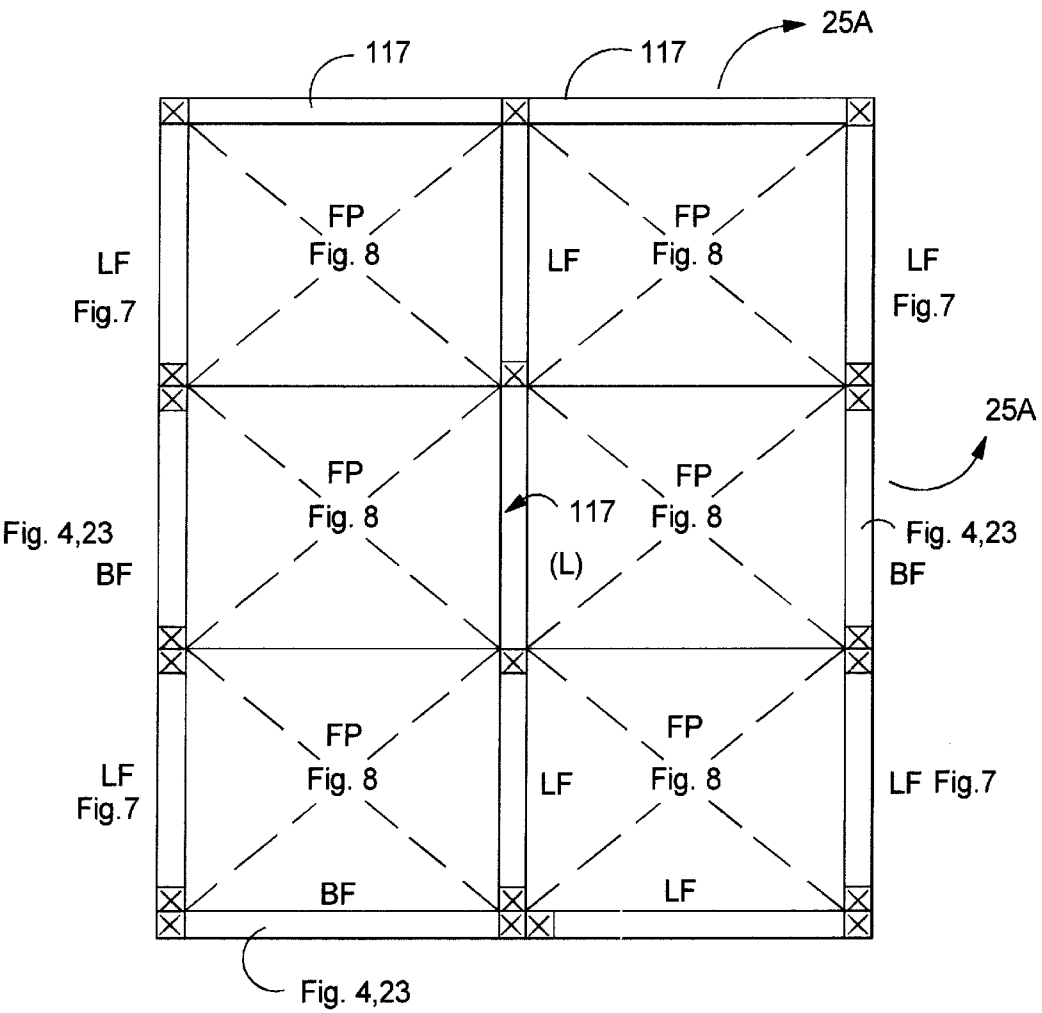
FIG. 25 is a top cross-sectional view of a space frame building.
Figure 29:
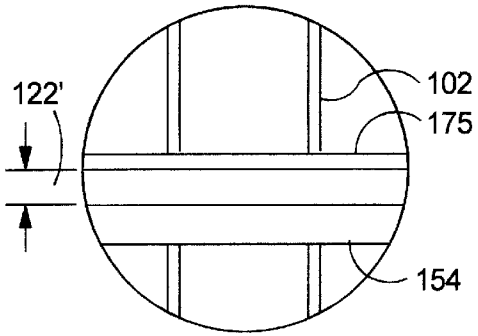
FIG. 29 is an enlarged detail view of a circled portion of FIGS. 27 and 28.

FIG. 25A is another alternative outrigger construction 118 (see FIG. 12) replacing the ladder frame.

Figure 27:
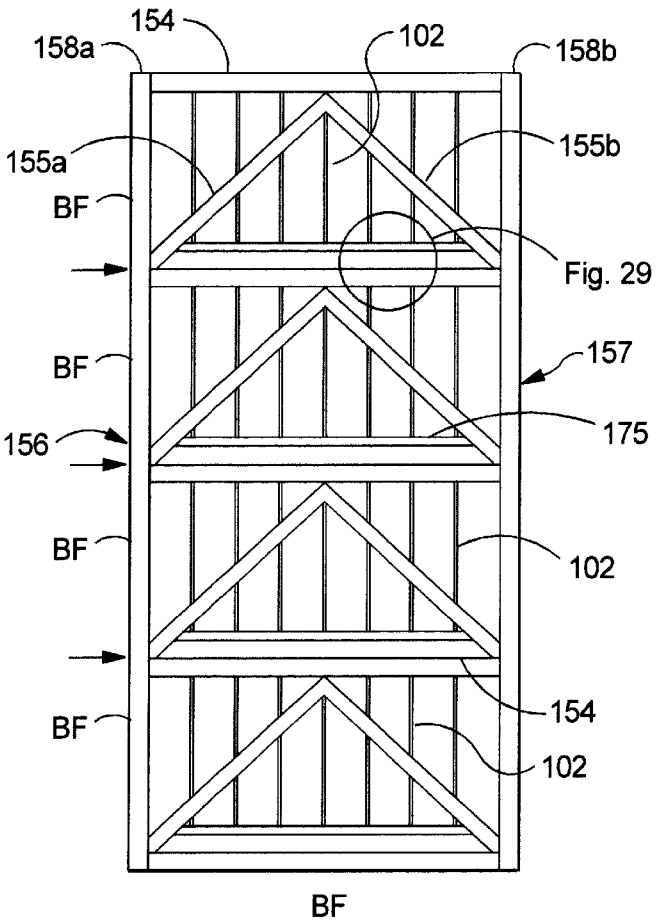
FIG. 27 is an elevation view of a bearing frame type of vertical frame assembly.

A typical vertical frame assembly formed of braced frames (BF) is illustrated in FIG. 27. Here, several individual braced frames (BF) form a prefabricated vertical assembly which, as illustrated in FIG. 25, may be used as a portion of the walls of a multi-story building. Each braced frame consists essentially of stacked wall panels of tubular hot-rolled steel structural members including as illustrated in FIG. 27 a top horizontal member 154 and V-shaped diagonal bracing members 155*a* and 155*b*. These are all tubular steel or hot-rolled. A unitary vertical frame assembly is formed by the top horizontal (or bottom if that is the orientation) steel members 154 and bracing members 155*a*, 155*b* being fastened (i.e., for example welded) to left and right hot-rolled steel members 156 and 157. These side members have a continuous uninterrupted length equal to the number of stacked wall panels; namely, in this particular illustration in FIG. 7, four. However, the vertical assembly may extend to m any stories. This is believed to be a superior construction compared to the individual welding of the panels as illustrated in FIG. 23. In addition, it is of lighter weight since there is only one horizontal member, for example, 154 required for each BF-type wall panel. In addition a gap 122' (see FIG. 13) between a bottom cold rolled support 107' and member 154 allows a continuous concrete floor to be poured. Infill members of light gauge C-section steel 102 are used to back drywall. When a longer vertical frame assembly is desired, the left and right vertical members 156 and 157 may be welded together, for example, as illustrated at the corners 158*a* and 158*b*.

Figure 28:
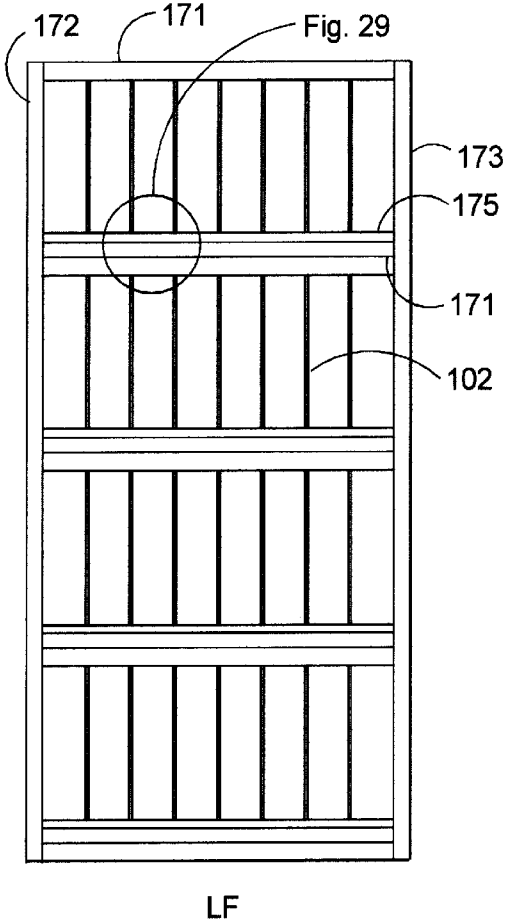
FIG. 28 is an elevation view of a ladder frame type of vertical frame assembly.

An equivalent ladder frame vertical assembly is illustrated in FIG. 28, see also FIG. 7, and includes horizontal members 171, side members 172 and 173 which are preferably continuous and the light gauge studs 102 which facilitate dry wall installation. Cold rolled horizontal steel members 175 are used to retain the studs 102; they also provide a gap 122' for a concrete floor.

Figure 30:
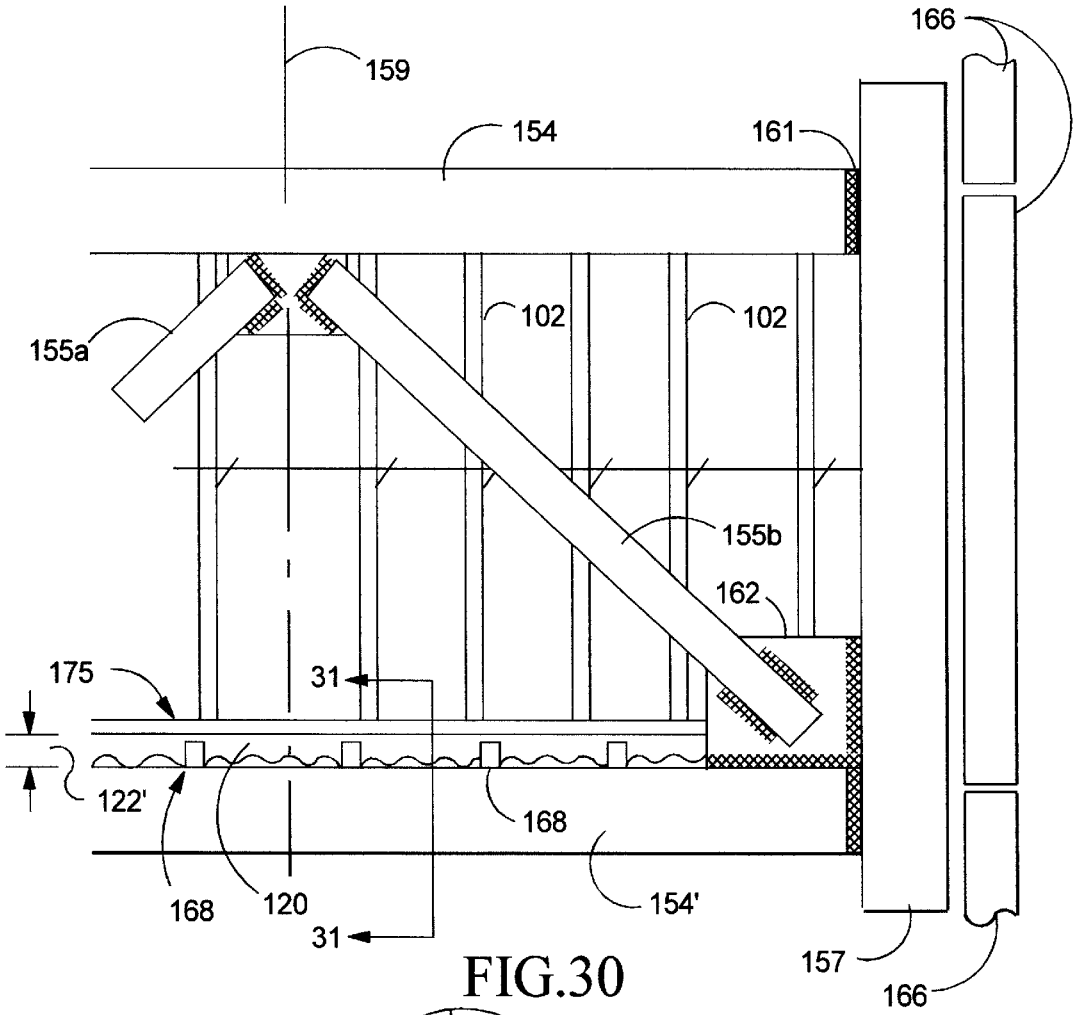
FIG. 30 is an enlarged detail view of a portion of FIG. 27.
Figure 31:
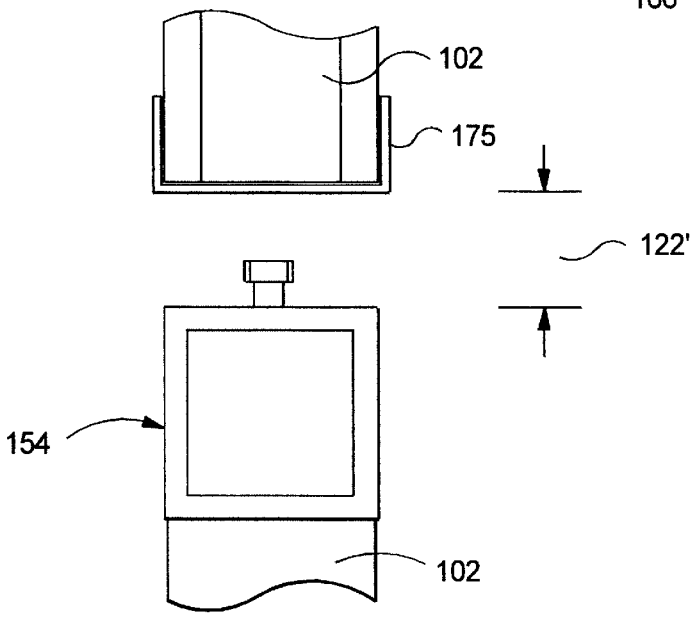
FIG. 31 is a cross-section taken along the line 31—31 of FIG. 30.

A more detailed view of a braced frame (or half of it) as in FIG. 27 is illustrated in FIG. 30 where the center line 159 shows only the right half of the braced frame with its top member 154, its infill C-section studs 102 and the diagonal member 155*b*, and the right vertical continuous side member 157. Side member 157 is welded at 161 to the horizontal member 154 and via a backing plate 162 to the diagonal member 155*b*. To support the C-section light gauge studs 102 at their bottoms, as also illustrated in FIG. 31, a light gauge bottom channel 107' is provided (see FIG. 27). This, of course, is merely to provide support for the wall studs 102 and does not support the structural integrity of the braced frame and its resistance to lateral and vertical forces. As indicated at 154', this is the horizontal member of the next lower wall bracing frame. The side member 157 is cladded, if it is the exterior of the building, with appropriate paneling 166. Because there is a gap 122' between the bottom member 163 and the horizontal member 154' of the next lower wall panel, a concrete floor 120 may be poured which in conjunction with T-shaped shear bolts 168 forms a continuous concrete floor which encapsulates the shear bolts on the horizontal members and forms a horizontal structural diaphragm to effectively hold the building together. The shear bolts may merely have an enlarged circular head which is equivalent to a "T."

Referring back to FIG. 25, the building as illustrated includes walls of bracing frames and ladder frames and beams 117 along with the outrigger construction shown in detail in FIG. 25A and 26. All of the walls, of course, are welded together as illustrated at the corners by welds 161. Concrete floor 120 is supported by the corrugated steel decking 127 laid upon light gauge C-section joists 126 or best shown in FIG. 17.

Figure 32:
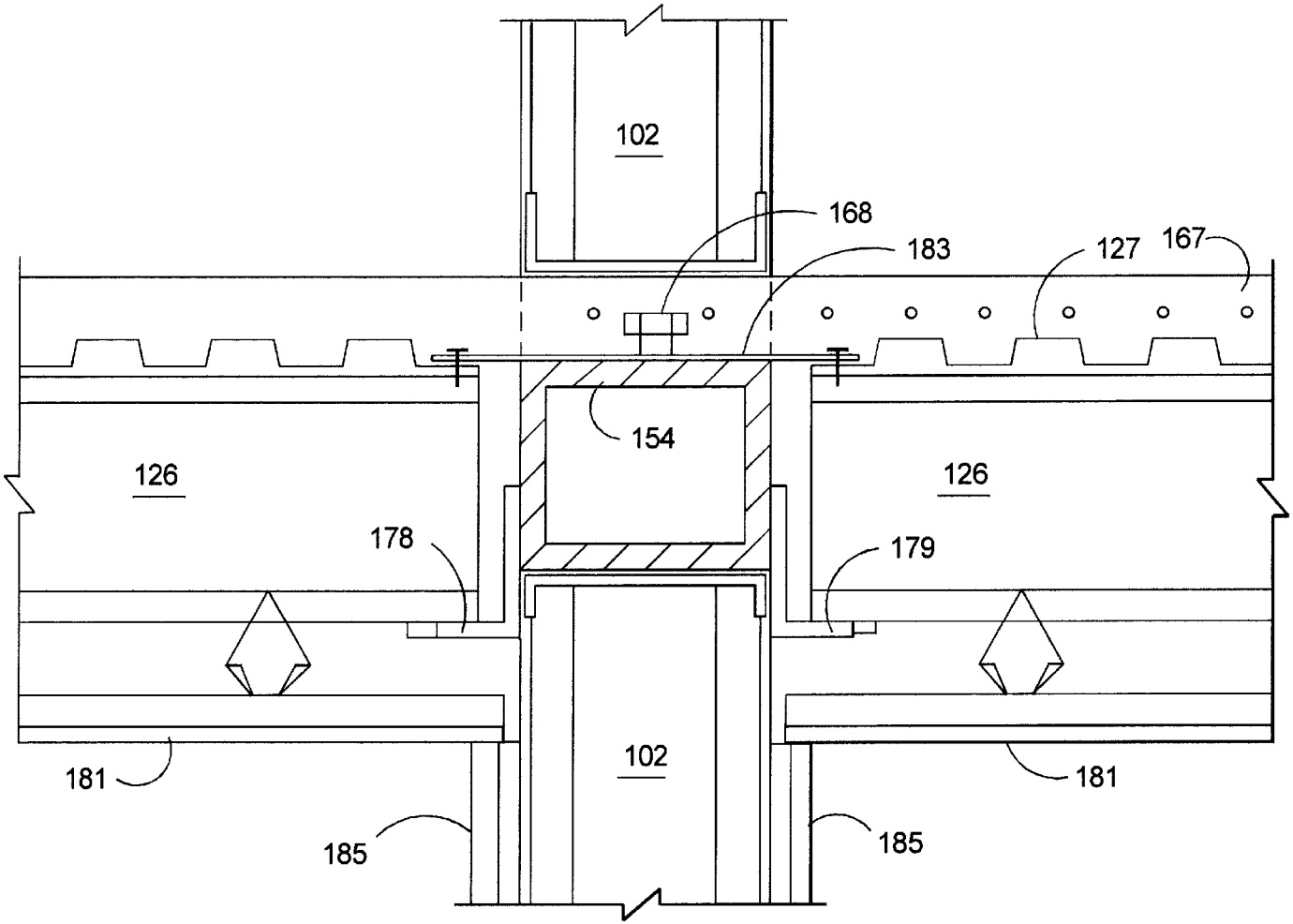
FIG. 32 is a cross sectional view similar to FIG. 13 but illustrating a different aspect of the invention.

FIG. 32 is a detailed floor/joint connection (related to FIG. 13) with the concrete floor 167 being illustrated with a typical shear bolt 168. The bolt is welded to the tubular horizontal member 154. The wall panels of a bracing frame or ladder frame are shown which also include the light gauge studs 102 to which the dry wall 185 may be fastened. Floor panels including joists 126 (see FIG. 8) are hung on the ledge angles 178 and 179 which are fastened to the tubular steel member 154. And, in a manner well known in the art, a suspended gypsum board ceiling 181 is provided. On top of the joists 176 and 177 is a corrugated metal deck 127 on which the cement floor 167 is poured. A metal plate 183 serves as a barrier between floors. Thus, the showing of FIG. 32 is similar to that of FIG. 13 except for the different type of vertical wall assembly which provides an uninterrupted gap between floors.

Thus, a improved high-rise building systems using steel wall panels has been provided by combinations of light gauge and hot rolled steel and also a technique of utilizing these panels in a vertical frame for a multi-story building.

What is claimed is:

1. In a multi-story building a prefabricated wall panel which is both load bearing and shear resistant which may be stacked on top of one another for use as a wall in the multi-story building comprising:

each of said panels having a frame consisting essentially of steel structural members including vertical members and top and bottom steel members which are formed of both cold rolled and hot rolled steel including means for vertically stacking and interlocking said panels, said cold rolled steel providing light weight and said hot rolled steel providing for enhanced resistance to vertical forces; and said means for stacking and interlocking including a plurality of discrete steel connectors each having a top and bottom with the top being welded to one of said top or bottom steel members and with the bottom being welded to the adjacent vertically stacked panel whereby enhanced resistance to shear is provided.

2. A wall panel as in claim 1 where said plurality of discrete connectors form a gap between adjacent vertically stacked panels such gap being filled with concrete to form a floor of said multi-story building.

3. A prefabricated vertical frame assembly which may be used as a portion of a wall in a multi-story building comprising a plurality of vertically stacked wall panels consisting essentially of tubular hot rolled steel structural members having top and bottom steel members, vertical side members connecting said top and bottom steel members of each panel and bracing means to resist lateral forces, said wall panels forming a unitary vertical assembly by said respective top and bottom steel members being fastened together.

4. A vertical assembly as in claim 3 here each said wall panel includes vertical members of light gauge cold rolled steel studs suitable for fastening a dry wall thereto.

5. A wall panel as in claim 1 including an elongated cover plate for one of said top and bottom steel members and extending beyond the width of said top and bottom steel members for covering adjacent floor panels.

6. A wall panel as in claim 5 which said cover plate has an opening to accommodate said discrete connectors.

7. A prefabricated vertical frame assembly which may be used as a portion of a wall in a multi-story building comprising a plurality of vertically stacked wall panels consisting essentially of tubular hot rolled steel structural members including a pair of horizontal steel members and at least one diagonal bracing member for resisting vertical and lateral forces, said wall panels forming a unitary vertical frame by said horizontal steel members and bracing members being fastened to a pair of vertical left and right hot rolled steel side members, said side members having a continuous uninterrupted length equal to said plurality of stacked panels.

8. A method of constructing a multi-story building having a plurality of spaced vertical frame assemblies, each of which includes a plurality of stacked wall panels, said wall panels including a combination of hot rolled and cold rolled steel members at least some of said assemblies forming a braced frame resistant to vertical and lateral forces, the spaced vertical frame assemblies being connected at each floor level by floor panels with attached corrugated steel decks at the top of the panels, said spaced vertical assemblies having a gap at each floor level to allow concrete floor fill placed above the floor panels to form a continuous slab and to act as a horizontal structural diaphragm tying the vertical assemblies together.

* * * * *